US006725504B1

(12) United States Patent
Dickson et al.

(10) Patent No.: US 6,725,504 B1
(45) Date of Patent: Apr. 27, 2004

(54) HINGE

(75) Inventors: Glenn Dickson, Glen Waverley (AU); Mal Urban, Germantown, TN (US)

(73) Assignees: Steelfinne Fabrications Pty. Ltd. (AU); ESI Companies, Inc., Memphis, TN (US)

( * ) Notice: Subject to any disclaimer, the term of this patent is extended or adjusted under 35 U.S.C. 154(b) by 0 days.

(21) Appl. No.: 09/959,068

(22) PCT Filed: Apr. 20, 2000

(86) PCT No.: PCT/AU00/00360

§ 371 (c)(1),
(2), (4) Date: Oct. 17, 2001

(87) PCT Pub. No.: WO00/65185

PCT Pub. Date: Nov. 2, 2000

(30) Foreign Application Priority Data

Apr. 23, 1999 (AU) ..... PP9957

(51) Int. Cl.[7] ..... E05D 7/04

(52) U.S. Cl. ..... 16/236; 16/237; 16/238; 200/61.7

(58) Field of Search ..... 16/236, 237, 238, 16/245, 244, 242; 200/61.7

(56) References Cited

U.S. PATENT DOCUMENTS 3,698,352 A * 10/1972 Forman ..... 116/86
3,715,537 A 2/1973 Peterson
4,049,934 A * 9/1977 Newlon ..... 200/61.7
4,066,857 A * 1/1978 Suska ..... 200/61.7
4,168,409 A * 9/1979 McNinch ..... 200/61.7
4,381,580 A * 5/1983 Hellstrom et al. ..... 16/243
4,841,283 A * 6/1989 Bubliewicz ..... 340/545.3
5,669,105 A * 9/1997 Depke ..... 16/245
5,774,938 A * 7/1998 Kent et al. ..... 16/332

FOREIGN PATENT DOCUMENTS

| | | | |
|---|---|---|---|
| AU | 43976/85 | | 8/1986 |
| DE | 004329750 | * | 3/1995 |
| EP | 001149976 | * | 10/2001 |
| JP | 10030373 A | | 2/1998 |

* cited by examiner

*Primary Examiner*—Gary Estremsky
*Assistant Examiner*—Mark Williams
(74) *Attorney, Agent, or Firm*—Cook, Alex, McFarron, Manzo, Cummings & Mehler, Ltd.

(57) ABSTRACT

An improved hinge assembly for use with gates, doors and the like, including respective first, second and third members, adapted to be releasably and adjustably mounted to a gate, door or the like and a jamb or the like therefor. The first member (1) has means (10, 11) associated therewith which allows for pivotal movement thereof relative to said second (2) and third members (3), thereby to allow for selective and controlled opening and/or closing of the gate, door or the like. The assembly further includes means which allows for the monitoring of the disposition of the gate, door or the like relative to the jamb or the like therefor, thereby to denote whether the gate, door of the like is open or closed. Means are also provided for selective vertical and/or horizontal adjustment of the hinge assembly.

25 Claims, 4 Drawing Sheets

HINGE

FIELD OF THE INVENTION

The present invention relates, in general terms, to improvements in hinges. More particularly, but not exclusively, the present invention relates to an improved form of heavy-duty hinge. The invention furthermore relates to an improved form of hinge which provides an indication as to the status of the door, gate or the like portal associated therewith, in terms of whether such door, gate or the like portal is open or closed.

For ease of explanation, throughout the ensuing description reference will be made to a particularly preferred embodiment of a hinge in accordance with the present invention, intended for use in structures such as prisons, remand centres, detention centres, asylums, etc., all being establishments wherein the need for security is paramount. It should be realised, however, that the present invention is not to be considered to be in any way limited to usage in such a context, building or the like structure. Indeed, the arrangement in accordance with the present invention readily lends itself to usage in any context or structure wherein a door, gate or the like portal is adapted to be pivotably and hingedly connected to a jamb or the like in a given structure. Indeed, the hinge in accordance with the present invention can be readily employed in any situation wherein relative pivotal movement occurs between two interconnected components.

In structures such as prisons, remand centres, detention centres, asylums and the like conventional hinges, especially conventional hinges of a light-weight type, have been found to be totally inappropriate for use on doors, gates and the like. By way of example only, in environments such as prisons and detention centres it would be totally unacceptable to use conventional light-weight hinges on cell doors and the like, since the very use of such light-weight hinges would give rise to serious risks in terms of the preservation of security within the overall complex. In such security-conscious complexes or establishments it has become the accepted practice to have doors, walls, etc., manufactured from suitable heavy-duty materials, which are substantially proof against damage (whether, deliberate or inadvertent), normal wear and tear, etc. It would therefore be totally incongruous to have any hinges or the like components, to be associated with or in use within such a complex, of anything less than of comparable strength to the doors, jambs or the like themselves. After all, such a complex as a prison is only as strong, meaning substantially proof against escape of inmates, as its weakest component. Past experience has shown that inmates of such prisons, detention centres and the like, confined within cells for significant periods of time, can be very inventive with their efforts to escape from their cells. The present invention, in one preferred aspect, therefore seeks to provide an improved means. whereby a hinged door or the like, for use in a detention centre, prison complex, asylum or the like structure is of a substantially uniform strength, with any hinges employed on such doors or the like exhibiting an improved strength resistance to impact, resistance to penetration, etc. To all practical purposes, the hinges or the like exhibiting resistance to damage which is at least equivalent to or commensurate with that of the overall door itself.

Furthermore, and insofar as doors, windows and the like used in such high security complexes are concerned, past experience has shown that problems can also be expected to be encountered in ensuring proper location thereof within a given building or the like structure. Despite the best efforts of the builders of such complexes and structures, problems can often be encountered due to such factors as the jamb in a doorway, on the sill of a hinged window, being in some way out of true, the floor being other than level, etc. In the alternative, and as can be more or less expected with the passage of time, settling of an overall structure or ageing thereof can give rise to warping or the like in the jamb area, sill area or the like thereby preventing ready opening of the door, window or the like or, in the alternative, perhaps even going so far as to prevent proper closing of that door, window or the like. The present invention therefore also seeks to overcome such problems by providing an arrangement which allows for ready adjustment or relocation of a door or the like, in both the vertical and/or horizontal direction relative to a jamb, doorway, sill or the like without there being any need for removal of the door, window and associated hinge from the door, jamb, frame or the like from which it is strung.

Nowadays, in any building or the like establishment employed for the detention of criminals, mentally disturbed persons, etc., or in any context or structure wherein a degree of security must be achieved, it is important to be able to closely monitor the status of any given door, gate or the like structure therewithin, in terms of whether that door, gate or the like is properly opened or properly closed. Preferably the status of the door, gate or the like should be capable of being monitored from a remote location, as for example from a central security area, control centre or the like. The arrangement in accordance with the present invention furthermore seeks to satisfy this requirement by providing an improved hinge for a door, gate or the like which incorporates therein means which allows for ready monitoring of the status of the door, in terms of it being open or closed. In an especially preferred embodiment in accordance with the present invention, the improved hinge is readily adjustable whereby to afford an indication of the status thereof to a variable degree.

In accordance with one aspect of the present invention there is provided an improved hinge assembly for gates, doors or the like, said hinge assembly including: a first member adapted, in use, to be affixed to a door, gate or the like; second and third respective upper and lower members adapted, in use, to be affixed to a jamb or the like for said door, gate or the like, wherein said first member includes means allowing for selective horizontal adjustment of the location of said door, gate or the like relative to said jamb or the like, and wherein at least one of said second and third members includes means allowing for selective vertical adjustment of the location of said at least one member relative to said jamb or the like and/or to said first member and said associated door, gate or the like, said first member further including a bore, extending in a substantially vertical direction therethrough, adapted to receive and releasably retain a pintle, shaft or the like member, wherein said pintle, shaft or the like member includes, at or in the vicinity of at least one free end thereof, a cam-like flat portion, and wherein in use opposed free ends of said pintle, shaft or the like member protrude outwardly from respective upper and lower free edges of said first member, to be releasably received by and within complementary-shaped bores of said second and third members, the arrangement allowing for pivotable movement of said first member relative to said second and third members, in turn giving rise to selective opening or closing of said door, gate or the like, said hinge assembly further including means which allow for continuous monitoring of the spatial disposition of said door, gate or the like relative to said jamb or the like, to generate a visible and/or audible signal in the instance of said door, gate or the like being ajar or pivotally displaced from said jamb or the like, and wherein said means for generating said signal includes a retractable member adapted to protrude into said bore of said second member, to be in engagement with said pintle, shaft or the like located therein, the arrangement being such that, when said pintle, shaft or the like is rotated, as by pivotal movement of the door, gate or the like, then when said cam-like flat portion is adjacent said retractable member said retractable member is released, thereby giving rise to generation of said signal.

In accordance with another aspect of the present invention there is provided an improved hinge assembly for gates, doors or the like, said hinge assembly including: a first member adapted, in use, to be affixed to a door, gate or the like; second and third respective upper and lower members adapted, in use, to be affixed to a jamb or the like for said door, gate or the like, wherein said first member includes means allowing for selective horizontal adjustment of the location of said door, gate or the like relative to said jamb or the like, and wherein at least one of said second and third members includes means allowing for selective vertical adjustment of the location of said at least one member relative to said jamb or the like and/or to said first member and said associated door, gate or the like, said first member further including a bore, extending in a substantially vertical direction therethrough, adapted to receive and releasably retain a pintle, shaft or the like member, wherein said pintle, shaft or the like member includes, at or in the vicinity of at least one free end thereof, a cam-like flat portion, and wherein in use opposed free ends of said pintle, shaft or the like member protrude outwardly from respective upper and lower free edges of said first member, to be releasably received by and within complementary-shaped bores of said second and third members, the arrangement allowing for pivotable movement of said first member relative to said second and third members, in turn giving rise to selective opening or closing of said door, gate or the like, said hinge assembly further including means which allow for continuous monitoring of the spatial disposition of said door, gate or the like relative to said jamb or the like, to generate a visible and/or audible signal in the instance of said door, gate or the like being ajar or pivotally displaced from said jamb or the like and wherein said means for generating said signal includes a retractable member adapted to protrude into said bore of said second member, to be in engagement with said pintle, shaft or the like located therein, the arrangement being such that, when said pintle, shaft or the like is rotated, as by pivotal movement of the door, gate or the like, then when said cam-like flat portion is adjacent said retractable member said retractable member is released, thereby giving rise to generation of said signal.

DESCRIPTION OF THE DRAWINGS

In order that the invention may be more clearly understood and put into practical effect there shall now be described in detail preferred embodiments of an improved hinge assembly in accordance with the invention. The ensuing description is given by way of non-limitative example only and is with reference to the accompanying drawings, wherein:

FIGS. 2, 3, 4 and 5 are respective front end, side elevation, rear end and edge view of a first or bar member of a hinge assembly in accordance with the invention, adapted in use to be affixed to a door or the like;

FIGS. 6, 7 and 8 are respective end, side elevation and edge views of a second or top block member of the hinge assembly in accordance with the present invention, a adapted in use to be affixed in any known manner to a door jamb, frame or the like; and FIGS. 9, 10 and 11 are respective end, side elevation and edge views of a third or lower member of the hinge assembly in accordance with the invention, also adapted, in use, to be affixed to a door jamb, frame or the like.

DESCRIPTION OF PREFERRED EMBODIMENTS

Figure 1:
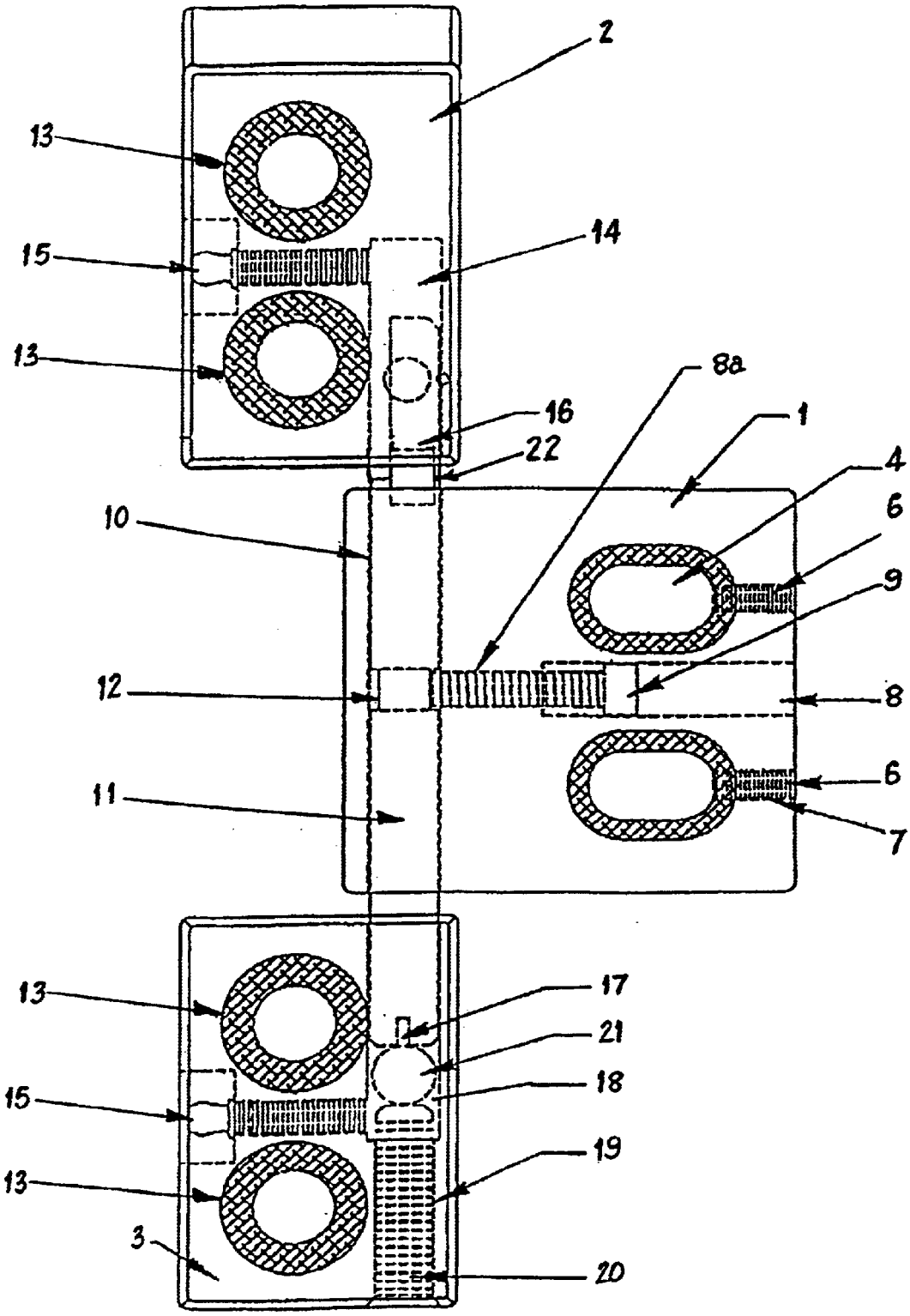
FIG. 1 is a cut-away side elevational view of a hinge assembly in accordance with the present invention, showing the various components thereof in detail.
Figure 4:
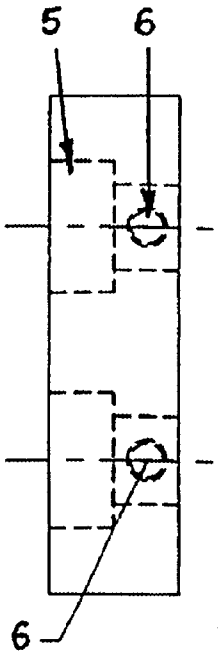
Figure 3:
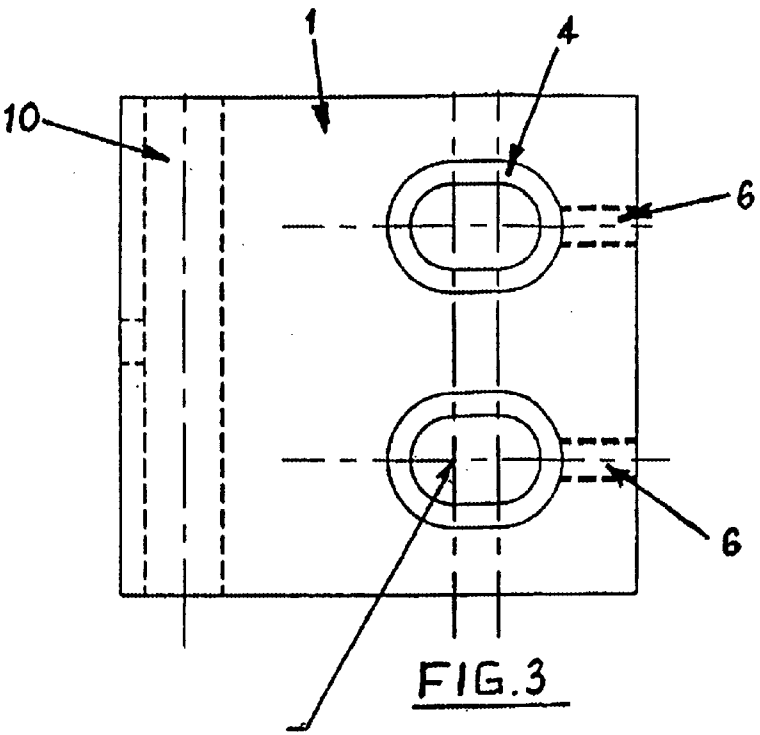
Figure 5:
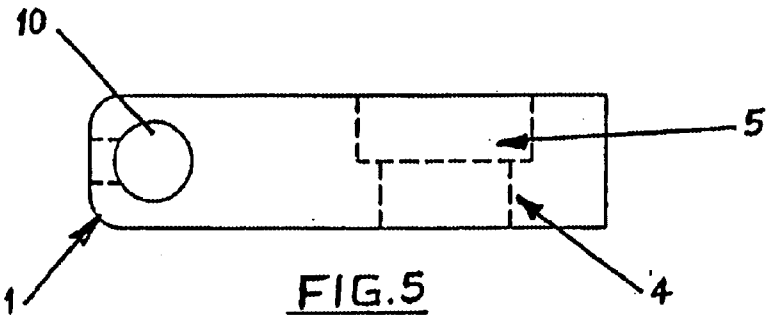
Figure 2:
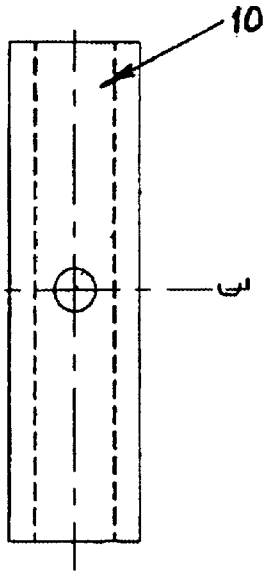
Figure 7:
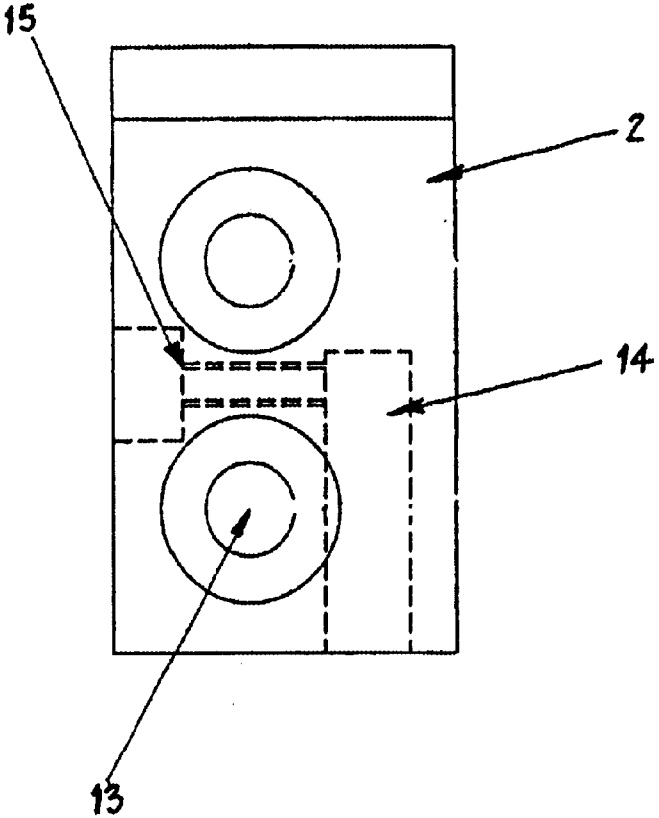
Figure 8:
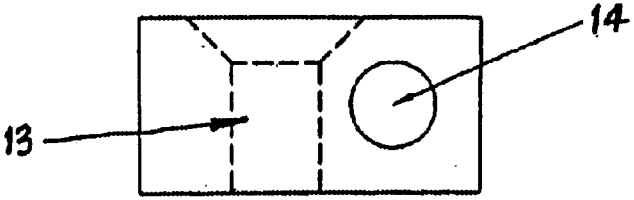
Figure 6:
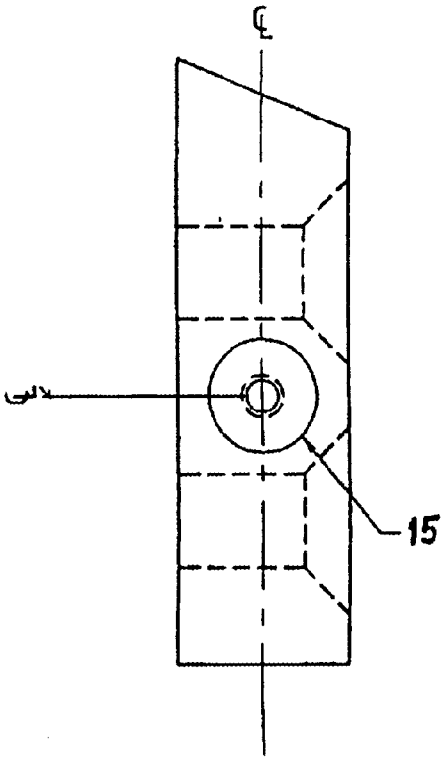
Figure 10:
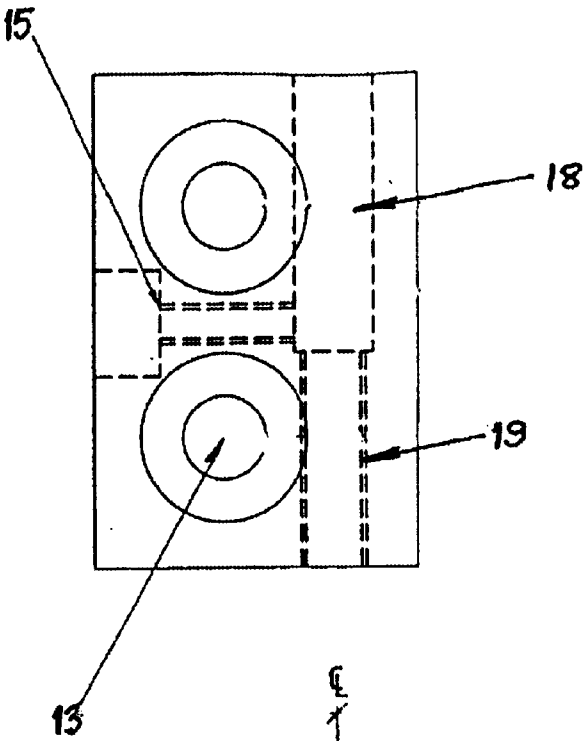
Figure 11:
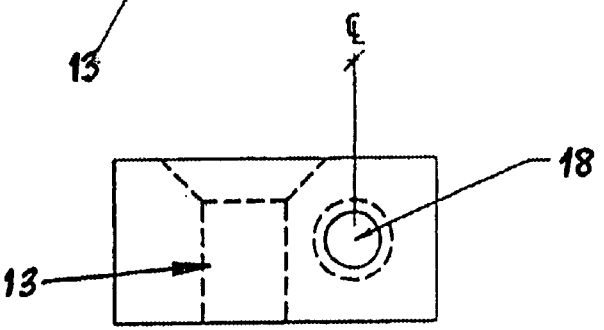
Figure 9:
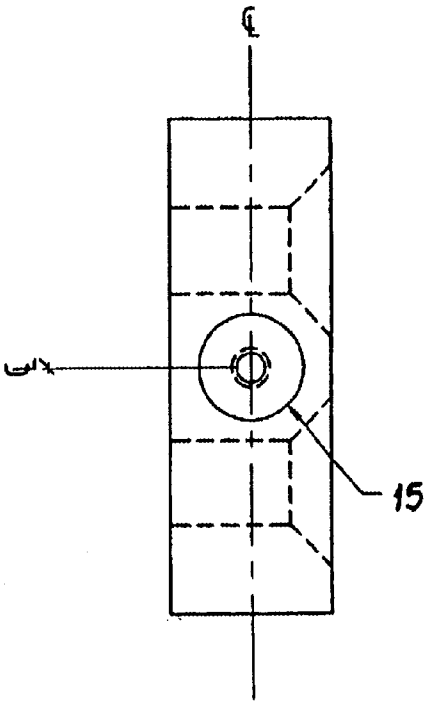

As illustrated in FIG. 1 a hinge in accordance with the present invention includes three principal components, namely a first or bar member 1 and respective second and third top and bottom block members 2 and 3. In accordance with the preferred embodiment illustrated the first member 1 is in the form of an elongate member of any suitable material, and preferably a heavy-duty material, as for example case-hardened steel or the like, which may be attached in any known manner to a door or an access panel. In order to allow for such attachment the first or bar member 1 preferably is provided with at least one, and more preferably two, slots 4, such slot or slots 4 being counter-sunk to receive and releasably retain fixing means of any given type, as for example set screws, bolts or the like (not shown). In the especially preferred embodiment illustrated two such slots 4 are provided, each including a rebate 5 adapted, in use, to receive and conceal the head of a set screw, bolt or the like fixing means allowing for fixing of the first or bar member 4 to a door or access panel, thereby to minimize the possibility of tampering with such fixing means, as for example by inmates. As can be seen the slots 4 extend substantially laterally of the first or bar member 1, thereby to allow for adjustment of the location of the first or bar member 1 on the door or access panel, in a manner to be explained hereinafter in more detail. To that end, and as shown, a threaded bore 6 extends from the edge of the first or bar member 1 into the or each slot 4. A screw or the like threaded means 7 may be located within that threaded bore 6 and adapted to extend into the slot 4, for engagement with any fixing means located therein. In such manner the horizontal position of the overall first or bar member 1 relative to the associated door or access panel may be varied or adjusted, to suit different installation requirements and to allow for possible slight variations in door size, possible warping thereof, etc. The arrangement is such that the horizontal location of the first or bar member 1 is readily adjustable in situ, without there being any need to remove and/or re-hang the door or the like associated therewith. This facility is of especial significance in structures where maintenance of security is paramount at all times.

The first or bar member 1 further includes another threaded bore, generally designated 8, having associated therewith a counter-bore 8*a* for receiving, and releasably retaining therein, a threaded means 9, as for example a cap screw or the like.

The first or bar member 1 includes yet a further bore 10, extending from top to bottom thereof. In the preferred embodiment illustrated such bore 10 is adapted to receive, and releasably retain, a hinge pin or pintle, generally designated 11. In the preferred embodiment illustrated the hinge pin or pintle 11 is adapted, in use, to extend through said bore 10, with the respective free ends thereof protruding outwardly therefrom, such free ends being adapted, in use, to co-operate with respective top and bottom block members 2 and 3, in a manner to be described in more detail hereinafter, whereby to allow for pivotal movement of said first or bar member 1 relative to said block members 2 and 3. At or in the vicinity of the mid-point of the pin or pintle 11 there is provided a circumferential slot 12. The arrangement is such that, in use, the cap screw or the like 9 located within the bore 8 of the first or bar member 1 protrudes into the slot 12 of the pin or pintle 11, thereby ensuring correct location of said pin or pintle 11 thereof within said first or bar member 1, whereby to allow for the requisite relative pivotal movement between the respective members 1, 2 and 3 of the overall hinge assembly. The arrangement is such that the first or bar member 1 is releasably and adjustably attachable to a door or the like, whilst the block members 2 and 3 may be releasably and adjustably attachable to a door jamb or the equivalent. The pin or pintle 11 then acts as an axis, in turn allowing for the desired relative pivotal movement of the associated door (not shown).

Both the top block member 2 and the bottom block member 3 are preferably constructed, in like manner to the first or bar member 1, of a heavy-duty material, as for example case-hardened steel or the like. Both block members 2 and 3 preferably include two counter-sunk bores 13 allowing for the location of fixings (not shown) of any given type, as for example bolts, screws or the like, therethrough whereby to allow for affixture of the block members 2 and 3 to a doorjamb, door panel or the like. Although now shown in the drawings, in like manner to the first or bar member 1 the respective block members 2 and 3 each may include means which allow for adjustment, in situ, of the position thereof relative to a door jamb or the like. Such could include counter-sunk bores in the form of elongate slots—as distinct from circular apertures.

As illustrated the top block member 2 includes a blind bore 14 which is adapted, in use, to receive and releasably retain a protruding free end of the hinge pin or pintle 11 of the overall hinge assembly, allowing for rotational movement of that hinge pin or pintle 11 therewithin and furthermore allowing for selected movement of the hinge pin or pintle 11 in a direction along the axis of said blind bore 14, thereby to allow for adjustment of the vertical location of the door or the like relative to the door jamb. Both top and bottom block members 2 and 3 include means, as for example grease nipples 15, allowing for lubrication as and when desired, thereby to ensure or allow for ready rotation of the pin or pintle within the blind bore 14.

The hinge pin or pintle 11 includes at one end thereof, being that end which, in use, is located within the blind bore 14 of the top block member 2, a cam type flat portion, generally designated 16. At the other end of the hinge pin or pintle 11, being that end which is intended, in use, to be disposed within a bore provided in the other or lower block member 3, there is provided a slot, generally designated 17. The cam type flat 16 takes the form of a flattened surface extending along a portion of the hinge pin or pintle 11, from the free end thereof.

At least the top block member 2 preferably has means associated therewith which, in use, provides an indication as to whether or not the door associated with the overall hinge is open. In an especially preferred embodiment a plunger type switch, generally designated 22, may be located so as to protrude into an opening of the door frame which in inaccessible to non-service personnel. The plunger of said switch protrudes into the bore 14 of the second member 2. The arrangement is such that, when the door is properly closed, he plunger of the switch will not be in any way depressed, in fact being disposed within the cavity provided by the cam type flat 16 of the hinge pin or pintle 11, between the hinge pin or pintle 11 and the surface of the blind bore 14 of the second block member 2. In the alternative the plunger will, when the door is closed properly, be depressed, with the pin or pintle 11 being so located and disposed within the bore 10 as to be in engagement with the plunger. When the door is rotated on its, hinge, the pin or pintle 11 will rotate within the bore 10, thereby either depressing or releasing the plunger (dependent upon the initial set-up thereof). In accordance with the present invention depression or release of the plunger generates a signal—which could be either visual and/or audible—thereby allowing for continuous monitoring of the status of the overall door. Preferably, as well as allowing for monitoring in the immediate vicinity of the door itself, remote monitoring will be possible.

In one preferred embodiment for example, the switch means may be in electrical connection with a visual display means—such as a light or lamp—or an audible means—such as a bell, buzzer or the like—located either in close proximity to the overall door or at a remote monitoring station therefor. Actuation of the switch, as by depressing or releasing the plunger, will therefore activate a visual and/or audible alarm, thereby warning that the door is open and constitutes a possible breach of security.

The third or lower block member 3 includes a bore 18 which is adapted, in use, to receive and releasably retain the downwardly protruding portion or free extremity of the hinge pin or pintle 11. In the especially preferred embodiment illustrated the third or lower block member 3 includes means which allows for adjustment thereof with reference to the first or bar member 1. Preferably such takes the form of a threaded bore 19 and associated threaded means 20 adapted to extend from the lower-most extremity or end of the block member 3 into the bore thereof. Such adjustment means allows for vertical adjustment or movement of the hinge pin or pintle 11, and associated first or bar member 1, as for example by engagement of the blade of a screw-driver or the like with the slot 17 provided in the lowermost end of the pin or pintle 11. In the especially preferred embodiment illustrated a ball-bearing or the like means 21 may be located within the lower block member 3, such serving to allow for ready pivotal movement of the hinged door and to ensure that the weight of the door itself on the overall hinge assembly does not give rise to jamming thereof.

The hinge assembly in accordance with the present assembly exhibits a member of important practical advantages when compared with the prior art arrangements.

Firstly, and by reason of the fact that the slots 4 and associated fixing means are arranged vertically one above the other on the first or bar member 1, then it is possible to create the illustrated arrangement wherein the bore 8 and cap-screw means 9 extend laterally of that first or bar member 1 to co-operate with the pin or pintle 11. This in turn allows for that pin or pintle 11 to be releasably associated with the first or bar member 1. Withdrawal of the end of the cap-screw means 9 from the circumferential slot 12 of the pin or pintle 11 may in turn allow for actual removal of the pin or pintle 11.

Secondly the utilization of a limit switch means of any suitable type, which in use co-operates with the pin or pintle 11, provides an extremely simple means for determining and/or monitoring the disposition of the door or the like within the structure, in other words whether it is open or closed. Monitoring of the disposition or status of the door can be achieved even from a remote location. Visible and/or audible monitoring means may equally well be employed.

Thirdly the configuration of the lower block member 3, with the threaded member 20 and ball bearing 21 both being removable therefrom whereby to allow access to the lowermost end of the pin or pintle 11, allows for ready adjustment of the door in a vertical direction within and relative to a given jamb or the like, even whilst the door is in position within that jamb. This is in marked contrast to the prior art arrangements wherein it was necessary, in order to bring about vertical alignment/adjustment of a given door, to first remove that door from the jamb or the equivalent. The improved security thus achievable with the present applicant's arrangement has obvious advantages. The overall integrity of the door space, and the security of the cell or the like with which such a door is associated, can be maintained at all times, even when being adjusted to make allowance for warping, ageing, etc.

Finally, it should be understood that the aforegoing description refers merely to preferred embodiments of the present invention and that variations and modifications will be possible thereto without departing from the spirit and scope of the invention, the ambit of which is to be determined from the following claims.

What is claimed is:

1. An improved hinge assembly for gates and/or doors, said hinge assembly including: a first member adapted, in use, to be affixed to either said door or gate or to a jamb therefor; second and third respective upper and lower members adapted, in use, to be affixed to either said jamb or to said door or gate, wherein said first member includes means allowing for selective horizontal adjustment of the location of said door or gate relative to said jamb therefor, and wherein at least one of said second and third members includes means allowing for selective vertical adjustment of the location of said at least one member relative to said jamb and/or to said first member and said associated door or gate, said first member further including a bore, extending in a substantially vertical direction therethrough, adapted to receive and releasably retain a pintle or shaft member, wherein said pintle or shaft member includes, at or in the vicinity of at least one free end thereof, a cam-like flat portion, and wherein use opposed free ends of said pintle or shaft member protrude outwardly from respective upper and lower free edges of said first member, to be releasably received by and within complementary-shaped bores of said second and third members, the arrangement allowing for pivotable movement of said first member relative to said second and third members, in turn giving rise to selective opening of closing of said door or gate, said hinge assembly further including means which allow for continuous monitoring of the spatial disposition of said door or gate relative to said jamb, to generate a visible and/or audible signal in the instance of said door or gate being ajar or pivotally displaced from said jamb, and wherein said means for generating said signal includes a retractable member adapted to protrude into said bore of said second member, to be in engagement with said pintle or shaft member located therein, the arrangement being such that, when said pintle or shaft member is rotated, as by pivotal movement of the door or gate, then when said cam-like flat portion is adjacent said retractable member said retractable member is released, thereby giving rise to generation of said signal.

2. The assembly as claimed in claim 1, wherein said first member is releasably and adjustably attachable to said gate or door by means of at least one counter-sunk, rebated slot extending therethrough, adapted in use to receive and releasably retain a fixing means.

3. The assembly as claimed in claim 2, wherein said fixing means is a threaded member.

4. The assembly as claimed in claim 3 wherein each slot, extending substantially laterally of said first member, has associated therewith and extending thereinto from an edge thereof a bore which is adapted, in use, to receive means which allows for selective horizontal displacement of said first member relative to said door or gate.

5. The assembly as claimed in claim 4, wherein said pintle or shaft member includes, at the other free end thereof remote from said cam-like flat portion, a slot extending in the direction of the longitudinal axis thereof.

6. The assembly as claimed in claim 1, wherein said pintle or shaft member includes at least one circumferential slot at a location along the length thereof.

7. The assembly as claimed in claim 6, wherein said slot is at a location substantially half-way along the length of said pintle or shaft member.

8. The assembly as claimed in claim 1, wherein said first member includes a further bore extending from the free edge thereof into said substantially vertical bore thereof, said further bore having a threaded section associated therewith and being adapted to receive, and releasably retain therein, a threaded member, said threaded member having one end thereof adapted, in use, to be disposed within said circumferential slot of said pintle or shaft member, thereby to prevent unwanted vertical movement of said pintle or shaft member.

9. The assembly as claimed in claim 1, wherein each of said second and third members includes at least one countersunk, rebated bore adapted to allow for releasable affixing of said member to said door jamb.

10. The assembly as claimed in claim 1, wherein each of the said second and third members includes means allowing for lubrication thereof, said means being in the form of at least one grease nipple.

11. The assembly as claimed in claim 1, wherein said retractable member is in the form of a plunger of a switch means.

12. The assemble as claimed in claim 11, wherein said signal activates audible and/or visual signal or alarm means, thereby to provide an indication/warning that said, door or gate is ajar and not closed.

13. An improved hinge assembly for gates and/or doors, said hinge assembly including: a first member adapted, in use, to be affixed to a door or gate; second and third respective upper and lower members adapted, in use, to be affixed to a jamb for said door or gate, wherein said first member includes means allowing for selective horizontal adjustment of the location of said door or gate to said jamb, and wherein at least one of said second and third members includes means allowing for selective vertical adjustment of the location of said at least one member relative to said jamb and/or to said first member and said associated door or gate, said first member further including a bore, extending in a substantially vertical direction therethrough, adapted to receive and releasably retain a pintle or shaft member, wherein said pintle or shaft includes, at or in the vicinity of at least one free end thereof, a cam-like flat portion, and wherein use opposed free ends of said pintle or shaft member protrude outwardly from respective upper and lower free edges of said first member, to be releasably received by and within complementary-shaped bores of said second and third members, the arrangement allowing for pivotable movement of said first member relative to said second and third members, in turn giving rise to selective opening of closing of said door or gate, said hinge assembly further including means which allow for continuous monitoring of the spatial disposition of said door or gate relative to said jamb, to generate a visible and/or audible signal in the instance of said door or gate being ajar or pivotally displaced from said jamb and wherein said means for generating said signal includes a retractable member adapted to protrude into said bore of said second member, to be in engagement with said pintle or shaft member located therein, the arrangement being such that, when said pintle or shaft member is rotated, as by pivotal movement of the door or gate, then when said cam-like flat portion is adjacent said retractable member said retractable member is released, thereby giving rise to generation of said signal.

14. The assembly as claimed in claim 13, wherein said first member is releasably and adjustable attachable to said gate or door, by means of at least one counter-sunk, rebated extending therethrough, adapted in use to receive and releasably retain a fixing means.

15. The assembly as claimed in claim 14, wherein said fixing means is a threaded means.

16. The assembly as claimed in claim 15, wherein each slot, extending substantially laterally of said first member, has associated therewith and extending thereinto from an edge of said first member a bore which is adapted, in use, to receive means which allows for lateral displacement of said first member relative to said gate or door.

17. The assembly as claimed in claim 16, wherein in use the opposed free ends of said pintle or shaft member protrude outwardly from respective upper and lower free edges of said first member, to be releasably received by and within complementary shaped bores of said second and third members, the arrangement allowing for pivotable movement of said first member relative to said second and third members, in turn giving rise to selective opening or closing of said gate or door.

18. The assembly as claimed in claim 17, wherein said pintle or shaft member includes at least one circumferential slot at a location along the length thereof.

19. The assembly as claimed in claim 18, wherein said first member includes a further bore extending from the free edge thereof into said substantially vertical bore thereof, said further bore being adapted to receive, and releasably retain therein, a threaded member, said threaded member having one end thereof adapted, in use, to be disposed within said circumferential slot of said pintle or shaft member, thereby to prevent unwanted vertical movement of said pintle or shaft member.

20. The assembly as claimed in claim 19, wherein said pintle or shaft member includes, at the other free end thereof remote from said cam-like flat portion, a slot extending in the direction of the longitudinal axis thereof.

21. The assembly as claimed in claim 20, wherein each of said second and third members includes at least one counter-sunk, rebated bore adapted to allow for releasable affixing of said member to said door jamb.

22. The assembly as claimed in claim 20, wherein each of the said second and third members includes means allowing for lubrication thereof, said means being in the form of at least one grease nipple.

23. The assembly as claimed in claim 18, wherein said slot is at a location substantially half-way along the length of said pintle or shaft member.

24. The assembly as claimed in claim 13, wherein said retractable member is in the form of a plunger of a switch means.

25. The assembly as claimed in claim 24, wherein said signal activates an audible and/or visual signal or alarm means.

* * * * *